US011005206B2

(12) United States Patent
Meixner et al.

(10) Patent No.: US 11,005,206 B2
(45) Date of Patent: May 11, 2021

(54) PLUG-IN COUPLING FOR A BATTERY UNIT

(71) Applicant: Hilti Aktiengesellschaft, Schaan (LI)

(72) Inventors: Ralf Meixner, Germaringen (DE); Johannes Stempfhuber, Utting am Ammersee (DE); Markus Holubarsch, Landsberg am Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/636,252

(22) PCT Filed: Aug. 3, 2018

(86) PCT No.: PCT/EP2018/071115
§ 371 (c)(1),
(2) Date: Feb. 3, 2020

(87) PCT Pub. No.: WO2019/030135
PCT Pub. Date: Feb. 14, 2019

(65) Prior Publication Data

US 2020/0373698 A1 Nov. 26, 2020

(30) Foreign Application Priority Data

Aug. 9, 2017 (EP) ..... 17185504

(51) Int. Cl.
*H01R 13/18* (2006.01)
*B25F 5/02* (2006.01)
*H01R 13/05* (2006.01)

(52) U.S. Cl.
CPC ..... *H01R 13/18* (2013.01); *B25F 5/02* (2013.01); *H01R 13/05* (2013.01)

(58) Field of Classification Search
CPC ..... H01R 13/05; H01R 13/18; B25F 5/02
(Continued)

(56) References Cited

U.S. PATENT DOCUMENTS 5,553,675 A * 9/1996 Pitzen ..... A61B 17/1628 173/217
6,304,058 B2 * 10/2001 Watson ..... H01M 2/1022 320/117
(Continued)

FOREIGN PATENT DOCUMENTS

CN 101237089 A 8/2008
CN 201430275 Y 3/2010
(Continued)

OTHER PUBLICATIONS

International Search Report of PCT/EP2018/071713, dated Oct. 25, 2018.

*Primary Examiner* — Peter G Leigh
(74) *Attorney, Agent, or Firm* — Davidson Davidson & Kappel, LLC

(57) ABSTRACT

A plug-in coupling (100) for making electrical contact with an electric drive (90) which is included in a hand-held power tool (200) and has a battery unit (20) which is to be accommodated by the hand-held power tool (200). The plug-in coupling (100) has at least one electrical contact plate (1) which is to be connected to the hand-held power tool (200), and at least one electrical contact spring pair (3) which corresponds to the contact plate (1), wherein the contact spring pair (3) is to be arranged on the battery unit (20) and is to be slid onto the contact plate (1) in the sliding-on direction (AR) and is to be withdrawn therefrom in the withdrawal direction (AB), wherein in the state in which contact is made (ZK) the contact plate (1) and the contact spring pair (3) form a frictionally locking latching-connection pairing.

15 Claims, 8 Drawing Sheets

(58) Field of Classification Search
USPC ..... 439/839
See application file for complete search history.

(56) References Cited

U.S. PATENT DOCUMENTS 6,329,788 B1 * 12/2001 Bailey, Jr. ..... B27B 9/02 320/114
6,350,149 B1 * 2/2002 Nakane ..... H01M 2/20 439/500
6,551,143 B2 * 4/2003 Tanaka ..... H01R 12/7088 439/224
6,729,413 B2 * 5/2004 Turner ..... H01M 2/1022 173/217
7,044,811 B2 * 5/2006 Chritz ..... H01R 13/11 439/856
7,121,848 B2 * 10/2006 Ono ..... H01R 12/57 439/83
7,125,270 B2 * 10/2006 Buck ..... H01M 2/1022 439/155
7,422,451 B2 * 9/2008 Chen ..... H01R 13/652 439/101
7,659,694 B2 * 2/2010 Griffin ..... H01R 13/6315 320/114
7,677,934 B2 3/2010 Piovesan
7,780,489 B2 * 8/2010 Stuklek ..... H01R 13/187 439/825
8,113,868 B2 2/2012 Glauning et al.
8,282,413 B2 * 10/2012 Fukumoto ..... B25F 5/00 439/500
8,366,497 B2 * 2/2013 Glick ..... H01R 13/187 439/839
8,475,220 B2 * 7/2013 Glick ..... H01R 13/18 439/839
8,575,745 B2 11/2013 Oka et al.
8,727,813 B2 * 5/2014 Yang ..... H01R 12/732 439/682
8,951,051 B2 * 2/2015 Natter ..... H01R 13/04 439/149
9,142,902 B2 * 9/2015 Glick ..... H01R 43/16
9,190,756 B2 * 11/2015 Glick ..... H01R 13/18
9,318,729 B2 * 4/2016 Ogura ..... H01M 2/1055
9,450,331 B1 * 9/2016 Luo ..... H01R 13/18
9,502,801 B2 * 11/2016 Ogura ..... H01R 13/04
9,525,254 B2 * 12/2016 Chen ..... H01R 27/02
9,548,553 B2 * 1/2017 Glick ..... H01R 13/18
2009/0053941 A1 * 2/2009 Stuklek ..... H01R 12/707 439/825
2012/0045667 A1 * 2/2012 Yoneda ..... H01M 2/1044 429/7
2014/0227915 A1 * 8/2014 Glick ..... H01R 13/113 439/856
2015/0303604 A1 * 10/2015 Rivera ..... H01R 13/113 439/817
2016/0226177 A1 * 8/2016 Chen ..... H01R 13/18
2020/0161609 A1 * 5/2020 Murakami ..... H01M 2/10

FOREIGN PATENT DOCUMENTS

CN 106099472 A 11/2016
DE 102011103781 A1 1/2012
DE 102011087414 A1 7/2012
DE 202016001856 U1 4/2016
JP 2016201301 A1 12/2016

* cited by examiner

PLUG-IN COUPLING FOR A BATTERY UNIT

The present invention relates to a plug-in coupling for making electrical contact with an electric drive which is included in a hand-held power tool and has a battery unit which is to be accommodated by the hand-held power tool. The plug-in coupling has at least one electrical contact plate which is to be connected to the hand-held power tool, and at least one electrical contact spring pair which corresponds to said contact plate. The contact spring pair is to be arranged on the battery unit and is to be slid onto the contact plate in the sliding-on direction and/or is to be withdrawn therefrom in the withdrawal direction.

Plug-in couplings of the type mentioned at the beginning are known in principle from the prior art.

SUMMARY OF THE INVENTION

It is an object of the present invention to make available a plug-in coupling which favors the reliable formation of contact between the contact plate and the contact spring pair, in particular against the background of vibrations and oscillations which are caused by the application.

The present invention provides that in the state in which contact is made the contact plate and the contact spring pair form a frictionally locking latching-connection pairing.

The invention includes the realization that, while the hand-held power tool is operating, not only the electrical loads in the form of current which are actually to be transmitted, but also mechanical loads act on the plug-in coupling. Owing to vibrations and oscillations which are caused by the application, the plug-in coupling experiences undesired acceleration forces. These can give rise to relative movements between the device-side contact plate and the battery-side contact spring pair. This usually gives rise to increased wear on the plug-in coupling, which is frequently even accelerated further by the intrusion of dust. Furthermore, as a result of an undesired relative movement between the contact plate and the contact spring pair, it is possible for the contact resistance of the contact pairing between these elements to be increased, which in turn brings about an undesired thermal overload, extending as far as loss of contact material.

These disadvantages are avoided by virtue of the fact that, in the state in which contact is made, the contact plate and the contact spring pair in the plug-in coupling according to the invention form a frictionally locking latching-connection pairing. This is the case, in particular, because the contact plate and the contact spring pair which are placed in contact with one another oscillate as one unit owing to the frictionally locking latching-connection pairing.

In contrast to solutions known from the prior art, for example from the plug-in coupling described in document U.S. Pat. No. 8,113,868, it is possible to dispense with a contact plate which has spring mounting on the device side. The contact plate of the plug-in coupling according to the invention is preferably arranged in a rigid fashion with respect to the hand-held power tool or a housing of the hand-held power tool.

The solution according to the invention has in turn the advantage that comparatively large tolerance compensation is possible in the contact pairing of the plug-in coupling, which is not the case in plug-in couplings which are known from the prior art and which have as the holder for the contact plate a sprung contact holder which moves as one entire unit.

In one preferred refinement, the contact plate has a groove which runs transversely with respect to the sliding-on direction and into which a latching projection, which is formed on the contact spring pair, can latch. The contact spring pair preferably has two spring elements which are located opposite one another and at each of which a latching projection is formed. The groove is preferably formed on both sides of the contact plate, so that a respective latching projection can latch into it.

In one particularly preferred refinement, the groove is embodied as an elongated hole. It has proven advantageous if the elongated hole has at least one chamfer in the sliding-on direction and/or in the withdrawal direction.

Alternatively to the refinement of the groove as an elongated hole, the groove can be part of a surface contour of the contact plate. The surface contour is preferably embodied in a complementary way to the contact spring pair.

In a further preferred refinement, the contact spring pair has a joining angle which is larger than a holding angle of the contact spring pair.

It has also proven advantageous if the contact plate has on the end face a preferably tapering coupling aid.

In one particularly preferred refinement, the contact spring pair has two elastic double tongues which are located opposite one another. Each of the double tongues can be supported via two additional spring elements which preferably counteracts spreading apart of the two elastic double tongues which are located opposite one another. The additional spring elements can be part of a plug housing of a contact plug. The contact spring pair is preferably part of such a contact plug.

In one particularly preferred refinement, the plug-in coupling has two, preferably precisely two, contact plates spaced apart from one another. Alternatively or additionally, the plug-in coupling can have two, preferably precisely two, contact spring pairs spaced apart from one another.

The invention is also achieved by a hand-held power tool having a plug-in coupling as described above, wherein the electrical contact plate of the plug-in coupling is, in particular rigidly, connected to the hand-held power tool, and the contact spring pair is arranged on a battery unit assigned to the hand-held power tool.

Further advantages can be found in the description of the figures that follows. The figures depict various exemplary embodiments of the present invention. The figures, the description and the claims contain numerous features in combination. A person skilled in the art will expediently also consider the features individually and combine them to produce further useful combinations.

BRIEF DESCRIPTION OF THE DRAWINGS

In the figures, identical and similar components are denoted by the same reference signs. In the figures.

DETAILED DESCRIPTION

Figure 1:
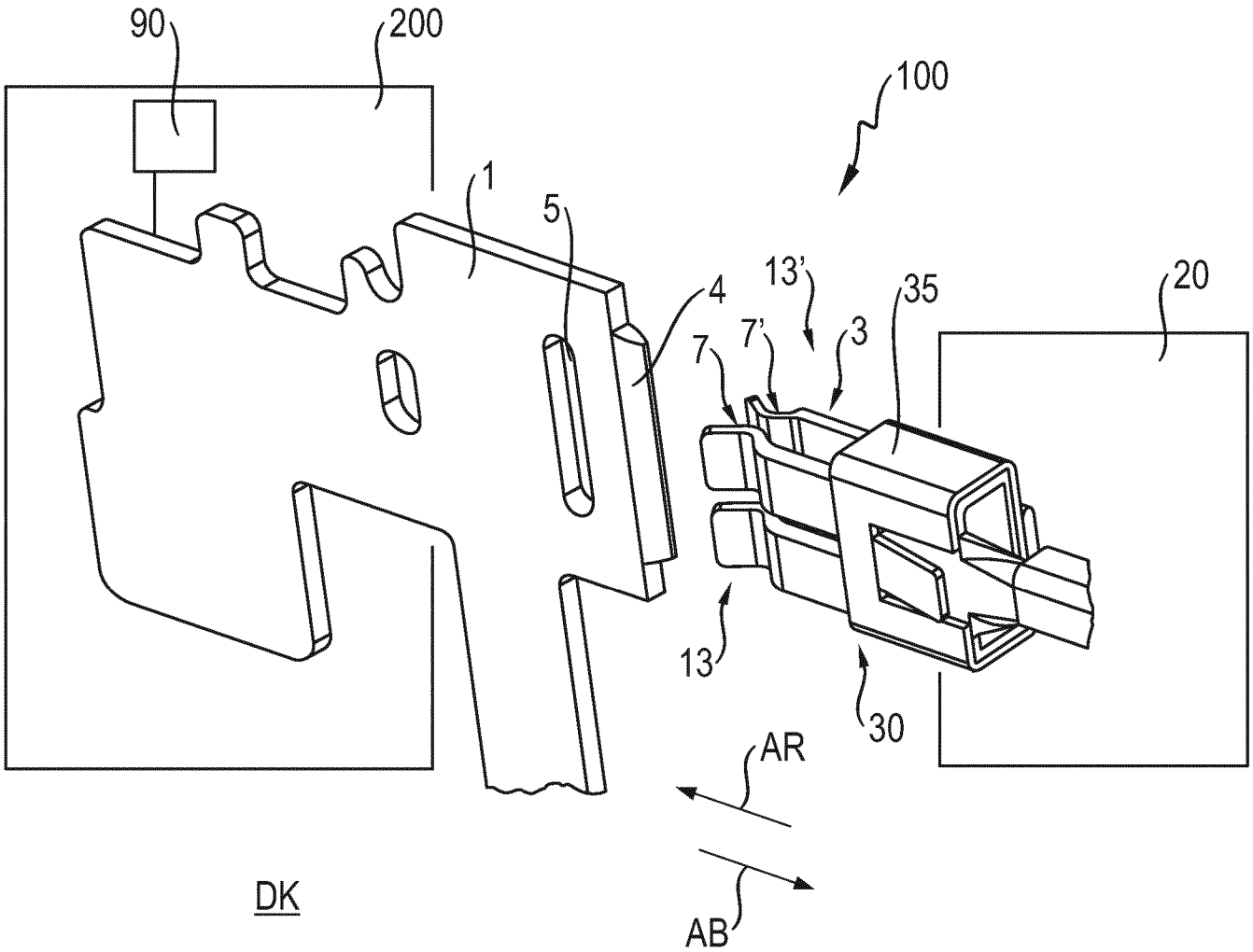
FIG. 1 shows a preferred exemplary embodiment of a plug-in coupling according to the invention in a disconnected state.

A preferred exemplary embodiment of a plug-in coupling 100 according to the invention is illustrated in FIG. 1. The plug-in coupling 100 is used for making electrical contact with an electric drive 90 which is included in a hand-held power tool 200 and has a battery unit which is to be accommodated by the hand-held power tool 200. The hand-held power tool 200, the electric drive 90 and the battery unit 20 are only illustrated schematically in FIG. 1.

The plug-in coupling 100 has at least one contact plate 1 which is to be connected, and in this case also is connected, to the hand-held power tool 200, and at least one electrical contact spring pair 3 which corresponds to said contact plate 1. The contact spring pair 3 is to be arranged, and in this case also is arranged, on the battery unit 20.

The contact spring pair 3 is to be slid onto the contact plate 1 in the sliding-on direction AR and is to be withdrawn from the contact plate 1 in the withdrawal direction AB.

The contact spring pair 3 is part of a contact plug 3 which itself has a plug housing 35 which at least partially surrounds the contact spring pair 3.

FIG. 1 shows the disconnected state DK in which the contact spring pair 3 electrical contact plate 1 are disconnected from one another.

According to the invention, the contact plate 1 and the contact spring pair 3 are embodied in such a way that in the state in which contact is made ZK (cf. FIG. 2) they form a frictionally locking latching-connection pairing.

In the exemplary embodiment illustrated here, this is achieved in that the contact plate 1 has a groove which runs transversely with respect to the sliding-on direction AR and which is embodied here as an elongated hole 5 into which latching projections 7, 7', which are formed on the contact spring pair 3, can latch.

In order to facilitate sliding of the contact spring pair 3 onto the contact plate 1, the contact plate 1 has on the end face a coupling aid 4 which tapers in the withdrawal direction. As can also be inferred from FIG. 1, the contact spring pair 3 has two elastic double tongues 13, 13' which are located opposite one another. Other refinements of the contact spring pair 3 are possible.

Figure 2:
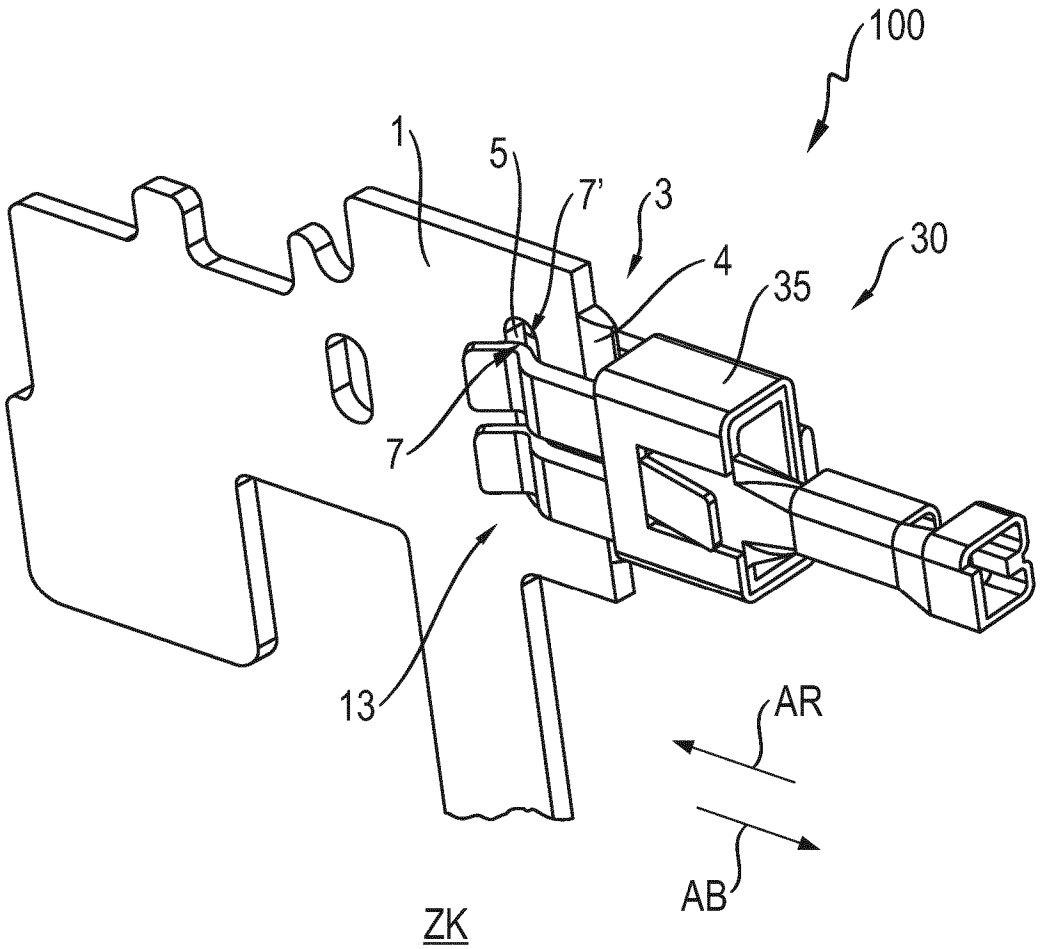
FIG. 2 shows the exemplary embodiment in FIG. 1 in the state in which contact is made.

FIG. 2 then shows the plug-in coupling 100 from FIG. 1 in the state in which contact is made ZK. In this state in which contact is made ZK, the contact plate 1 and the contact spring pair 3 form a frictionally locking latching connection. In other words, the latching projections 7, 7' which are formed on the contact spring pair 3 are clipped at both sides in the groove 5, which is embodied as an elongated hole, in the contact plate 1. This frictionally locking latching-connection pairing prevents, but at least reduces, relative movement between the contact plate 1 and the contact spring pair 3 also while the hand-held power tool is operating, so that in the state in which contact is made ZK the contact pairing oscillates as one unit.

Figure 3:
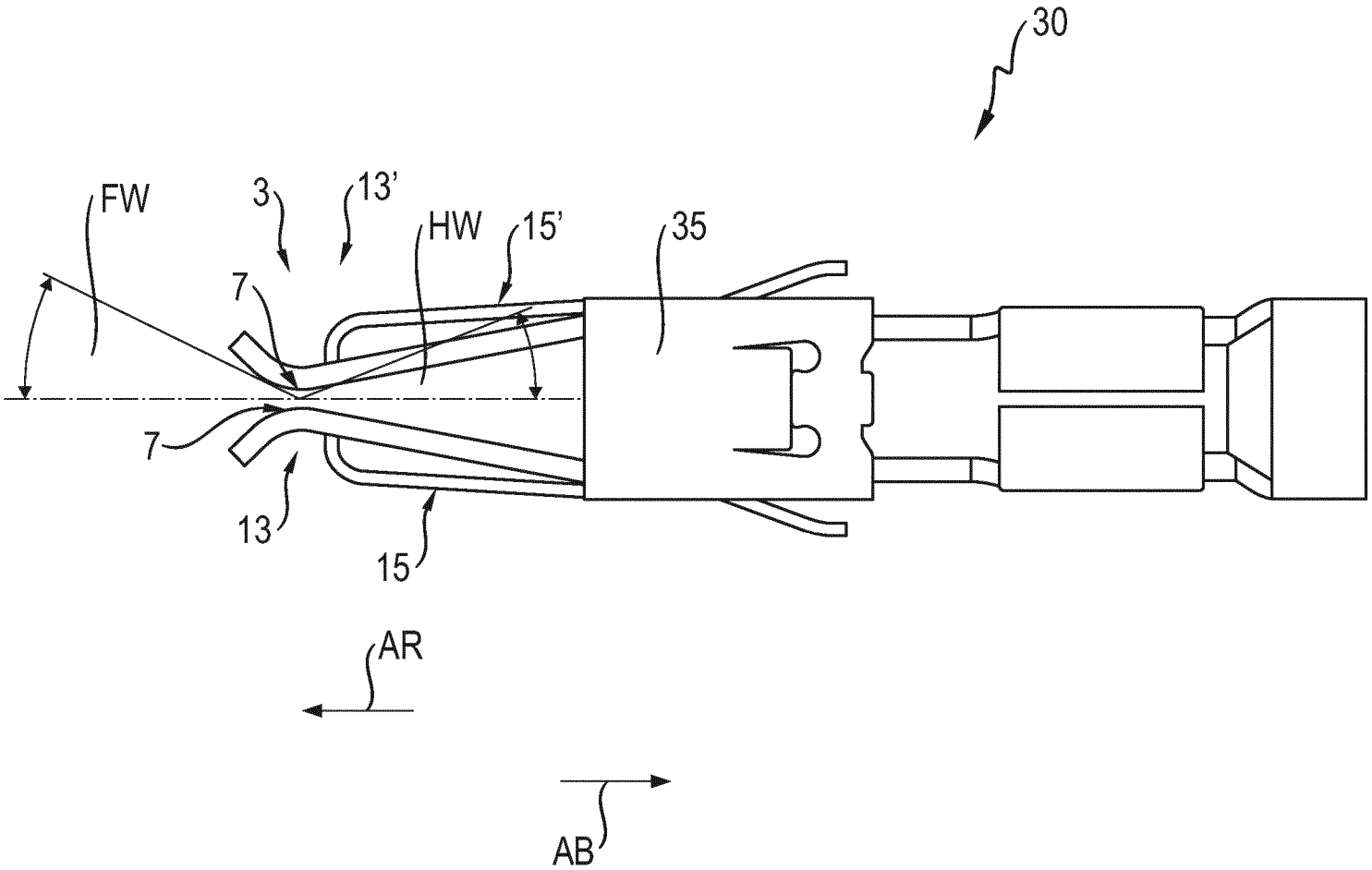
FIG. 3 shows a more precise illustration of the contact plug of the exemplary embodiment from FIGS. 1 and 2.

FIG. 3 then shows a contact plug 30, which includes the contact spring pair 3, in a plan view. The elastic double tongues 13, 13' which are located opposite one another and on each of which the latching projection 7, 7' is formed can be seen clearly. The latching projections 7, 7' can be formed, for example, by cold shaping (sheet metal forming).

As can be inferred from FIG. 3, a joining angle FW of the contact spring pair 3 is larger than a holding angle HW of the contact spring pair 3. The joining angle FW is preferably between 30 and 50 degrees, particularly preferably between 35 and 45 degrees.

Despite the fact that in the exemplary embodiment shown the joining angle FW is larger than the holding angle HW, comparatively simple sliding of the contact spring pair 3 onto the contact plate 1 is possible, since the latter (cf. FIG. 1) has a coupling aid which is arranged on the end face.

It can also be clearly seen in FIG. 3 that each of the double tongues 13, 13' is supported via two additional spring elements 15, 15'. The additional spring elements 15, 15' counteract spreading apart, in particular excessive spreading apart of the two elastic double tongues 13, 13' which are located opposite one another. The additional spring elements 15, 15' can be embodied in one piece with a plug housing 35 of the contact plug 30. The contact spring pair 3 is, for its part, pressed onto a side facing away from the latching projections 7, 7' within the plug housing 35.

Figure 4:
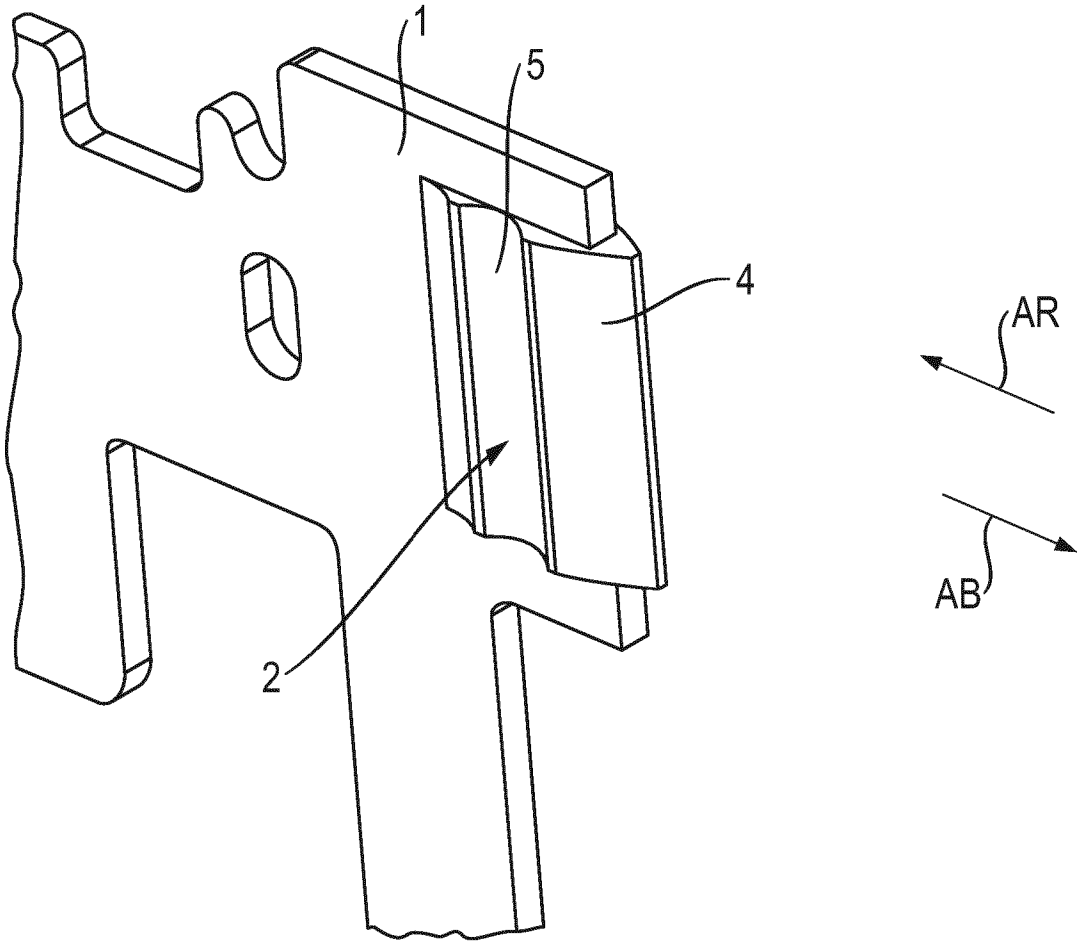
FIG. 4 shows a second exemplary embodiment of a contact plate of a plug-in coupling according to the invention.

FIG. 4 shows a further exemplary embodiment of a contact plate 1 of a plug-in coupling according to the invention. The contact plate 1 has a groove 5 which runs transversely, to be more precise perpendicularly, with respect to the sliding-on direction AR and into which latching projections 7, 7' (cf. FIG. 3) which are formed on the contact spring pair 3 can latch in order to thereby form a frictionally locking latching-connection pairing.

As an alternative to the refinement of the groove 5 as an elongated hole (cf. FIG. 1), in the exemplary embodiment in FIG. 4 the groove 5 is part of a surface contour 2 of the contact plate 1, wherein the surface contour 2 is embodied in a complementary way to the contact spring pair 3.

In this exemplary embodiment too, the contact plate 1 has on the end face a coupling aid 4 tapering in the withdrawal direction AB.

Figure 5:
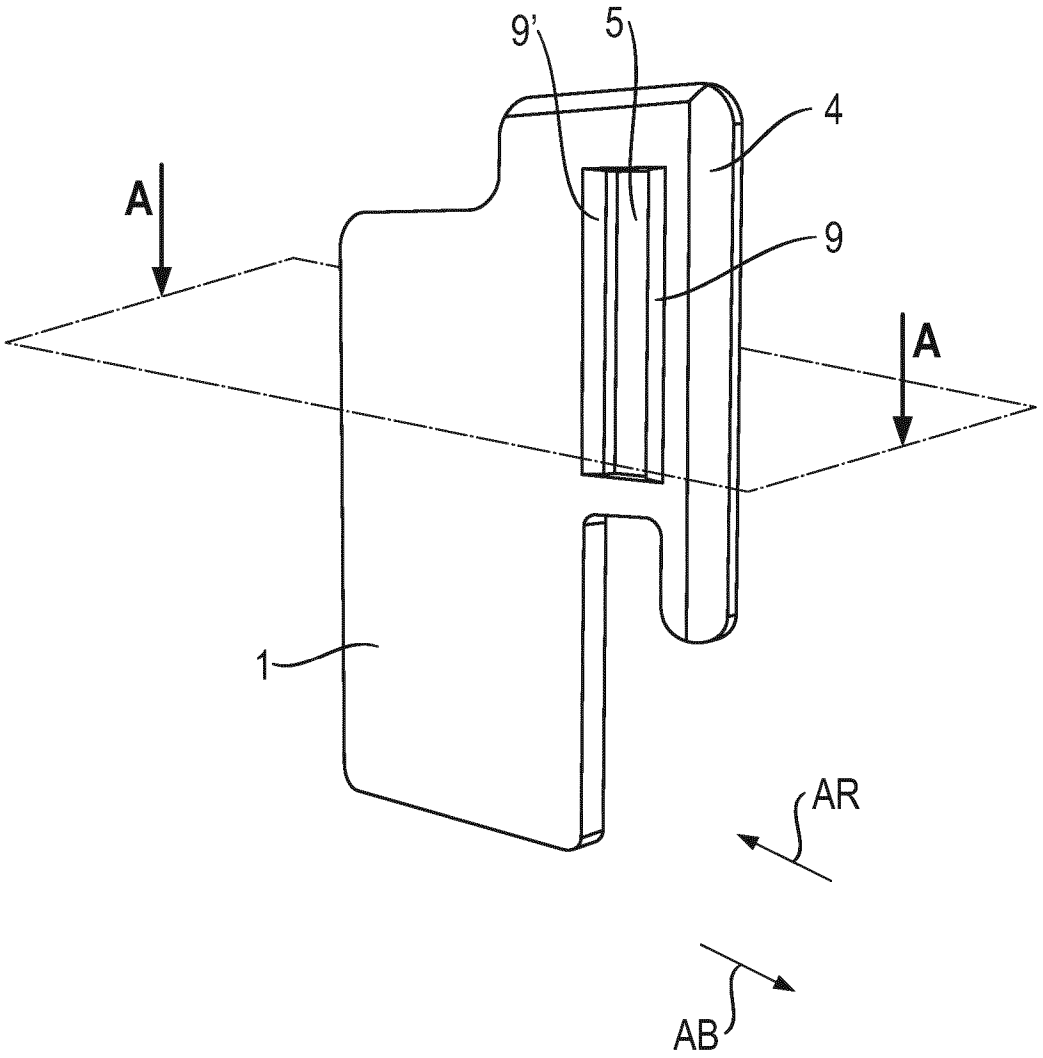
FIG. 5 shows a third exemplary embodiment of a contact plate as part of a plug-in coupling according to the invention.

A further exemplary embodiment of a contact plate 1 is shown in FIG. 5. The contact plate 1 has a groove 5 which runs transversely with respect to the sliding-on direction AR and is embodied here as an elongated hole. A chamfer 9, 9' is formed both in the sliding-on direction AR and in the withdrawal direction AB on the groove 5 which is embodied as an elongated hole, in order to facilitate sliding of a contact plug onto the contact plate 1 and withdrawal of said contact plug therefrom. The chamfers 9, 9' extend transversely, to be more precise perpendicularly, with respect to the sliding-on direction AR and the withdrawal direction AB.

Figure 6:
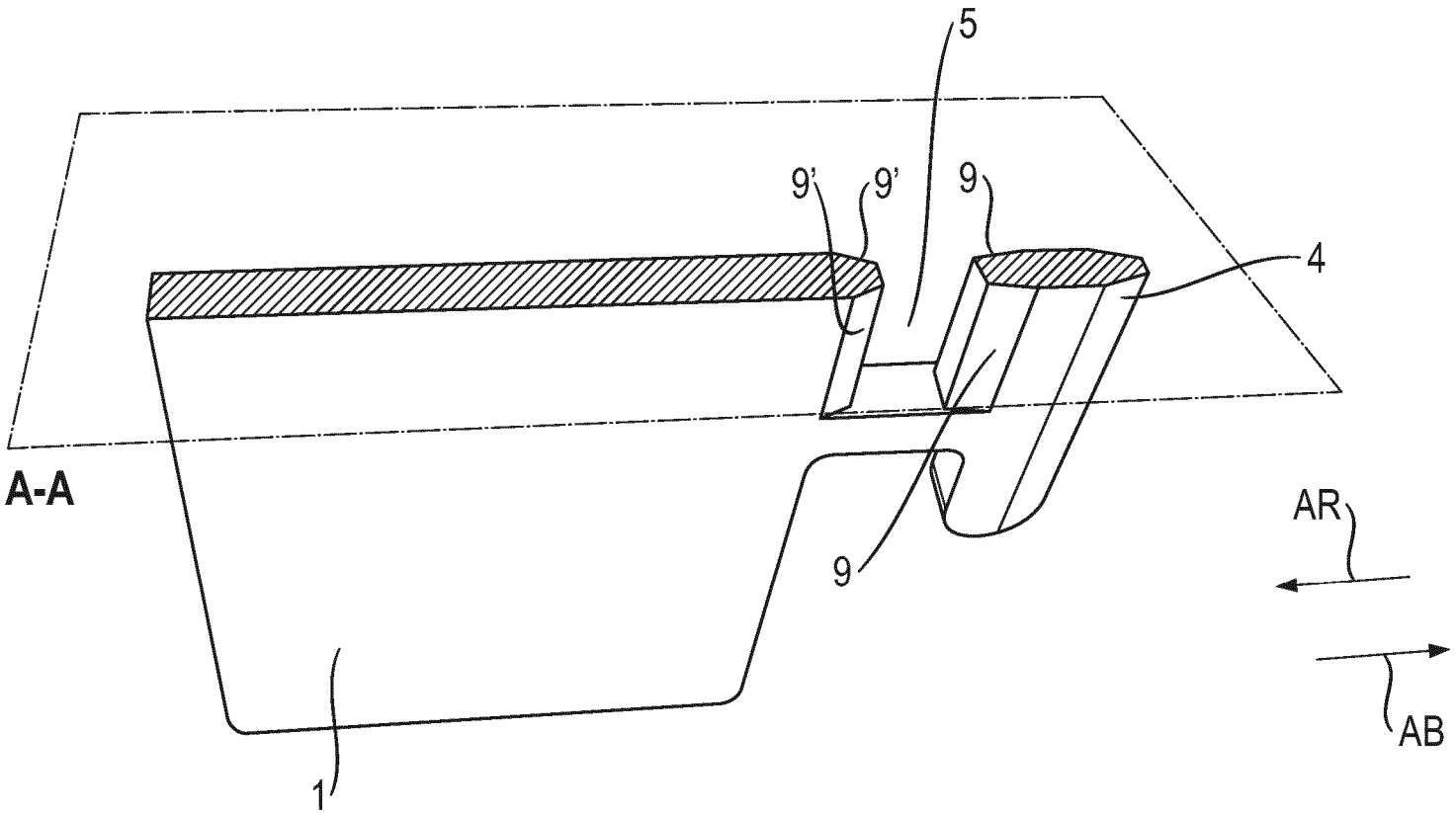
FIG. 6 shows a section through the illustration from FIG. 5.

FIG. 5 shows a sectional plane A-A, the section A-A of which is illustrated in FIG. 6. It can be seen particularly clearly in FIG. 6 that the chamfers 9, 9' which are provided in the sliding-on direction AR and in the withdrawal direction AB are formed on both sides of the contact plate 1 on the on the groove 5 which is embodied as an elongated hole.

Figure 7:
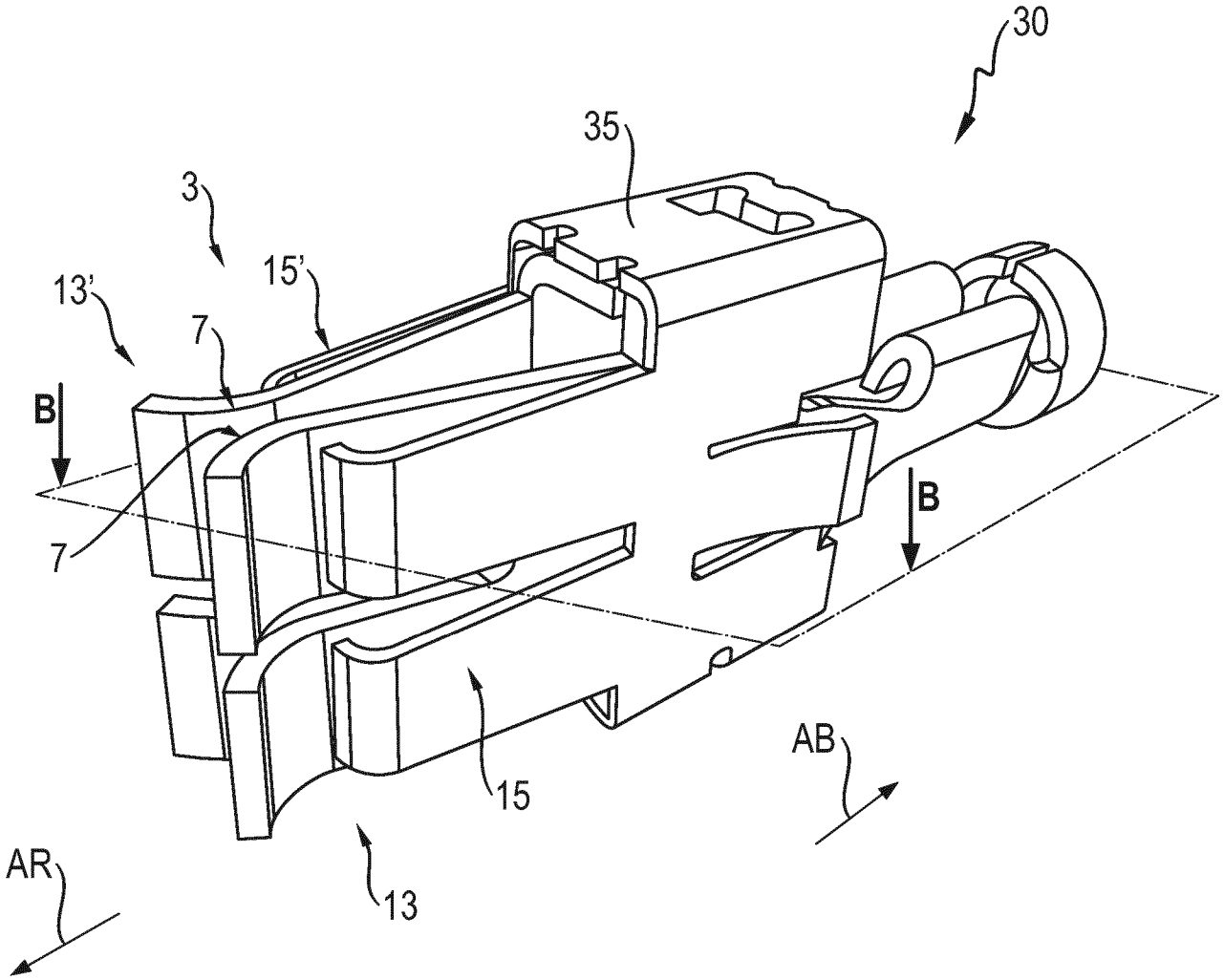
FIG. 7 shows a fourth exemplary embodiment of a contact plug of a plug-in coupling according to the invention.

FIG. 7 now shows a perspective illustration of the contact plug 30 from FIG. 3 with the sectional plane B-B indicated. The two additional spring elements 15, 15' which serve to support the elastic double tongues 13, 13' which are located opposite one another can be clearly seen.

The two additional spring elements 15, 15' are embodied in one piece with the plug housing 35. At least one section of the contact spring pair 3 is pressed into the plug housing 35.

Figure 8:
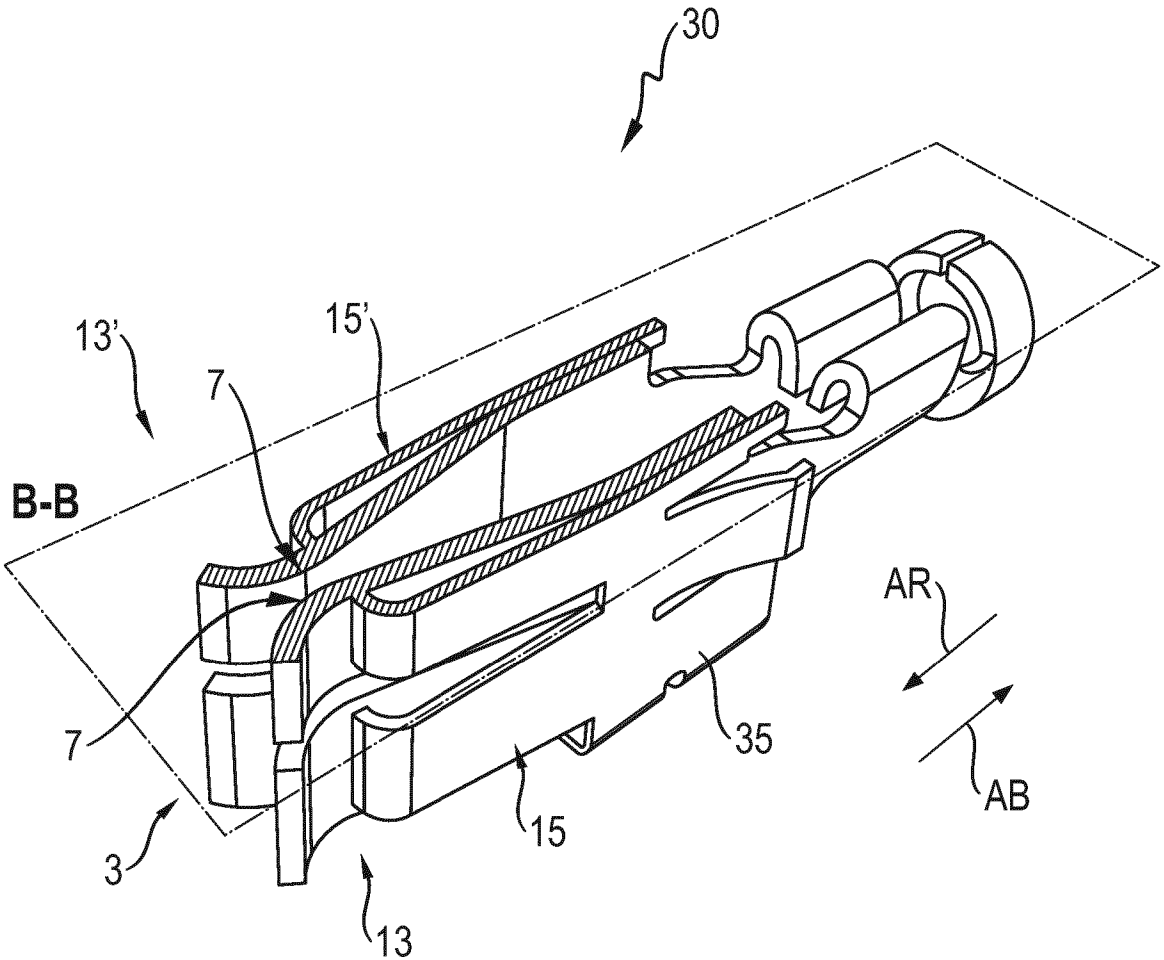
FIG. 8 shows the view from FIG. 7 in a sectional illustration.

Finally, FIG. 8 shows the section B-B through the contact plug 30 from FIG. 7. As can be inferred from FIG. 8, one section of the contact spring pair which faces away from the latching projections 7, 7' fits snugly against the plug housing 35, in parallel within said plug housing 35. Moreover, in FIG. 8 it can be clearly seen that the additional spring elements 15, 15' are in contact at the other end with the contact spring pair 3 in the region of the latching projections 7, 7'.

LIST OF REFERENCE NUMBERS

1 Contact plate
2 Surface contour
3 Contact spring pair
4 Coupling aid
5 Groove
7, 7' Latching projection
9, 9' Chamfer
13, 13' Double tongue
15, 15' Additional spring elements
20 Battery unit
30 Contact plug
35 Plug housing
90 Electric drive
100 Plug-in coupling
200 Hand-held power tool
AR Sliding-on direction
AB Withdrawal direction
FW Joining angle
HW Holding angle
ZK State in which contact is made
DK Disconnected state

What is claimed is:

1. A plug-in coupling for making electrical contact with an electric drive included in a hand-held power tool and a battery unit to be accommodated by the hand-held power tool, the plug-in coupling comprising:

at least one electrical contact plate connectable to the hand-held power tool; and at least one electrical contact spring pair corresponding to the contact plate, the contact spring pair arrangable on the battery unit and slidable onto the contact plate in a sliding-on direction and withdrawable from the contact plate in a withdrawal direction;

in a contact state, the contact plate and the contact spring pair forming a frictionally locking latch-connection pairing;

the contact spring pair having free ends facing the contact plate in the sliding-on direction.

2. The plug-in coupling as recited in claim 1 wherein the contact plate has a groove running transversely with respect to the sliding-on direction, a latching projection formed on the contact spring pair being latchable into the groove.

3. The plug-in coupling as recited in claim 2 wherein the groove is an elongated hole.

4. The plug-in coupling as recited in claim 3 wherein at least one chamfer is formed on the elongated hole in the sliding-on direction or in the withdrawal direction.

5. The plug-in coupling as recited in claim 2 wherein the groove is part of a surface contour of the contact plate, wherein the surface contour is complementary to the contact spring pair.

6. The plug-in coupling as recited in claim 1 wherein the contact plate has a coupling aid on an end face.

7. The plug-in coupling as recited in claim 6 wherein the coupling aids tapers.

8. The plug-in coupling as recited in claim 1 wherein the contact spring pair has two elastic double tongues located opposite one another.

9. The plug-in coupling as recited in claim 8 wherein each of the double tongues is supported via two additional spring elements counteracting spreading apart of the two elastic double tongues.

10. The plug-in coupling as recited in claim 1 wherein the plug-in coupling has two contact plates of the at least one contact plate spaced apart from one another or two contact spring pairs of the at least one spring pair spaced apart from one another.

11. A hand-held power tool comprising the plug-in coupling as recited in claim 1, wherein the electrical contact plate of the plug-in coupling is connected to the hand-held power tool, and the contact spring pair is arranged on the battery unit assigned to the hand-held power tool.

12. The plug-in coupling as recited in claim 1 wherein the contact spring pair diverge away from each other toward the free ends.

13. The plug-in coupling as recited in claim 12 wherein the contact spring pair diverge away from each other toward the free ends with at least a joining angle FW from a central axis at a closest converging point of the contact spring pair, the contact spring pair also diverging away opposite the joining angle FW from the closest point at a holding angle HW, the joining angle FW being larger than the holding angle HW.

14. The plug-in coupling as recited in claim 1 wherein in the contact state the contact spring pair contact the contact plate in only one connection along the sliding-in direction.

15. The plug-in coupling as recited in claim 1 wherein in the contact state the contact spring pair contact the groove in only one connection along the sliding-in direction.

* * * * *